US009915397B2

(12) United States Patent
Jean et al.

(10) Patent No.: US 9,915,397 B2
(45) Date of Patent: Mar. 13, 2018

(54) APPARATUS FOR STORING AND TRANSPORTING A CRYOGENIC FLUID ON-BOARD A SHIP

(71) Applicant: GAZTRANSPORT ET TECHNIGAZ, Saint Remy les Chevreuse (FR)

(72) Inventors: Pierre Jean, Dampierre En Yvelines (FR); Karim Chapot, Prunay En Yvelines (FR)

(73) Assignee: GAZTRANSPORT ET TECHNIGAZ, Saint Remy les Chevreuse (FR)

( * ) Notice: Subject to any disclaimer, the term of this patent is extended or adjusted under 35 U.S.C. 154(b) by 0 days.

(21) Appl. No.: 15/547,246

(22) PCT Filed: Jan. 14, 2016

(86) PCT No.: PCT/FR2016/050067

§ 371 (c)(1),
(2) Date: Jul. 28, 2017

(87) PCT Pub. No.: WO2016/120540

PCT Pub. Date: Aug. 4, 2016

(65) Prior Publication Data

US 2017/0363253 A1 Dec. 21, 2017

(30) Foreign Application Priority Data

Jan. 30, 2015 (FR) ..... 15 50746

(51) Int. Cl.
*F17C 13/00* (2006.01)
*B63B 25/14* (2006.01)
*B63B 25/16* (2006.01)

(52) U.S. Cl.
CPC ..... *F17C 13/004* (2013.01); *B63B 25/14* (2013.01); *B63B 25/16* (2013.01);
(Continued)

(58) Field of Classification Search
CPC ..... F17C 1/00; F17C 13/00; F17C 13/082; B63B 25/00; B63B 25/08; B63B 25/12; B63B 25/14; B63B 25/16; B63B 25/18
(Continued)

(56) References Cited

U.S. PATENT DOCUMENTS 3,984,059 A * 10/1976 Davies ..... B63B 27/24 138/114
4,144,829 A 3/1979 Conway
4,155,482 A * 5/1979 Swaney ..... B63B 25/16 220/560.11

FOREIGN PATENT DOCUMENTS

DE 41 07 184 C1 5/1992
EP 2 157 013 A1 2/2010
(Continued)

OTHER PUBLICATIONS

International Search Report for PCT/FR2016/050067 filed on Jan. 14, 2016.
(Continued)

*Primary Examiner* — Lars A Olson
(74) *Attorney, Agent, or Firm* — Notaro, Michalos & Zaccaria P.C.

(57) ABSTRACT

An apparatus for storing and transporting a cryogenic fluid. The apparatus is carried onboard a ship. The apparatus including a sealed and thermally insulating tank intended for the storage of the cryogenic fluid in a state of liquid-vapor diphasic equilibrium, the apparatus including at least two sealed pipes passing through the tank in such a way as to define a passage for the removal of the vapor phase of the cryogenic fluid from inside to outside the tank, the two sealed pipes each including a collection end opening inside the tank at the level of the sealing membrane of the top wall. The collecting ends of two sealed pipes open to the inside of
(Continued)

the tank at the level of two zones of the top wall which are situated at two opposite ends of the top wall.

18 Claims, 7 Drawing Sheets

(52) U.S. Cl.
CPC ..... *F17C 2201/0157* (2013.01); *F17C 2201/052* (2013.01); *F17C 2203/0358* (2013.01); *F17C 2203/0631* (2013.01); *F17C 2205/0332* (2013.01); *F17C 2205/0341* (2013.01); *F17C 2205/0352* (2013.01); *F17C 2205/0355* (2013.01); *F17C 2221/033* (2013.01); *F17C 2223/0161* (2013.01); *F17C 2223/033* (2013.01); *F17C 2223/043* (2013.01); *F17C 2225/046* (2013.01); *F17C 2225/047* (2013.01); *F17C 2227/0157* (2013.01); *F17C 2260/021* (2013.01); *F17C 2260/035* (2013.01); *F17C 2265/032* (2013.01); *F17C 2265/034* (2013.01); *F17C 2270/0107* (2013.01)

(58) Field of Classification Search
USPC ..... 114/74 A, 74 R; 220/560.11, 560.15
See application file for complete search history.

(56) References Cited

FOREIGN PATENT DOCUMENTS

| | | | |
|---|---|---|---|
| EP | 2 228 294 | A1 | 9/2010 |
| FR | 2691520 | A1 | 11/1993 |
| FR | 2915729 | A1 | 11/2008 |
| FR | 2968284 | A1 | 6/2012 |
| JP | 63-132200 | | 8/1988 |
| JP | 2012-032118 | | 2/2012 |
| KR | 20100133051 | A | 12/2010 |
| WO | 03/038333 | A1 | 5/2003 |
| WO | 2005/009876 | A2 | 2/2005 |
| WO | 2005/063562 | A1 | 7/2005 |
| WO | 2008/099977 | A1 | 8/2008 |
| WO | 2010/055244 | A1 | 5/2010 |
| WO | 2013/093261 | A1 | 6/2013 |

OTHER PUBLICATIONS

International Preliminary Report on Patentability for PCT/FR2016/050067 filed on Jan. 14, 2016.
International Search Authority Written Opinion for PCT/FR2016/050067 filed on Jan. 14, 2016.
International Preliminary Report on Patentability Translation for PCT/FR2016/050067 filed on Jan. 14, 2016.

* cited by examiner

APPARATUS FOR STORING AND TRANSPORTING A CRYOGENIC FLUID ON-BOARD A SHIP

TECHNICAL FIELD

The invention relates to the field of cryogenic-fluid transport and storage facilities and apparatuses carried onboard ships and comprising one or more sealed and thermally insulated membrane-type tanks.

The tank(s) may be intended to transport cryogenic fluid or to receive cryogenic fluid serving as propellant fuel for the ship

TECHNOLOGICAL BACKGROUND

Ships for transporting liquefied natural gas have a plurality of tanks in which to store the cargo. The liquefied natural gas is stored in these tanks, at atmospheric pressure, at around −162° C., and is thus in a state of diphasic liquid-vapor equilibrium such that the heat flux applied through the walls of the tanks tends to cause the liquefied natural gas to evaporate.

In order to avoid the generation of overpressures inside the tanks, each tank is associated with a sealed pipe for removing the vapor produced by the evaporation of the liquefied natural gas. Such a sealed vapor removal pipe is notably described in application WO2013093261, for example. The pipe passes through a wall of the tank and opens in an upper part of the internal space of the tank and thus defines a vapor passage between the interior space of the tank and a vapor collector arranged outside the tank. The vapor thus collected may then be transmitted to a re-liquefaction apparatus so that the fluid can then be reintroduced into the tank, to energy production equipment or to a flare stack provided on the deck of the ship.

However, under certain incident conditions, when the tank fill level is at a maximum and the ship has run aground in a position in which it has an inclination in that it is listing and/or an inclination in terms of trim to (a) significant extent(s), there is a risk that the vapor removal pipe will open into the liquid phase and therefore no longer be in contact with the vapor phase stored in the tank. In such circumstances isolated pockets of gas in the vapor phase are liable to form inside the tanks. Now, such pockets of gas are liable to give rise to overpressures which may damage the tanks and/or lead to liquid phase being expelled to the outside of the tank through the aforementioned vapor removal pipe.

In order to limit the probabilities of such isolated pockets of gas forming, it is admittedly known practice to limit the maximum tank fill level. However, such limiting of the tank fill level leads to a loss of revenue for the carriers and is therefore not entirely satisfactory.

SUMMARY

One idea underlying the invention is to propose a cryogenic-fluid storage and transport facility or apparatus carried onboard a ship which makes it possible to reduce the risks of such isolated pockets of gas in the vapor phase forming inside a tank without being able to be removed therefrom.

According to one embodiment, the invention provides an apparatus for storing and transporting a cryogenic fluid, which apparatus is carried onboard a ship, the apparatus comprising a sealed and thermally insulating tank intended for the storage of the cryogenic fluid in a state of liquid-vapor diphasic equilibrium, said tank having a horizontal top wall comprising, in the thickness direction from the outside toward the inside of the tank, at least one thermally insulating barrier and one sealing membrane intended to be in contact with the cryogenic fluid; the apparatus comprising at least two sealed pipes passing through the tank in such a way as to define a passage for the removal of the vapor phase of the cryogenic fluid from inside to outside the tank, the two pipes each comprising a collection end opening inside the tank at the level of the sealing membrane of the top wall; the collecting ends of said two pipes opening to the inside of the tank at the level of two zones of the top wall which are situated at two opposite ends of said top wall.

Thus, when the ship is immobilized in an inclined position in which one of its two opposite ends is raised relative to the other, at least one of the two pipes opens into a high-up zone of the top wall and is thus able to remove the vapor phase of the cryogenic fluid stored in the tank.

Consequently, such an arrangement of the vapor removal pipes makes it possible to increase the maximum filling level of the tank.

According to some embodiments, such an apparatus or facility may comprise one or more of the following features.

According to one embodiment, said two ends of the top wall are opposite in a transverse direction perpendicular to the longitudinal direction of the ship. In other words, the collecting ends of said two pipes opening into the tank at two zones of the top wall are located at two opposite ends in a transverse direction perpendicular to the longitudinal direction of the tank. Thus, when the ship is immobilized in an inclined position in which it exhibits an lodging inclination, at least one of the two pipes opens into a high zone of the top wall and is thus able to evacuate the vapor phase of the cryogenic fluid stored in the tank, at least as long as the trim of the ship is not too high.

According to one embodiment, said two ends of the horizontal top wall are opposite in the longitudinal direction of the ship. Thus, when the ship is immobilized in an inclined position in which its longitudinal axis is inclined, at least one of the two pipes opens into a high-up zone of the top wall and is thus able to remove the vapor phase of the cryogenic fluid as long as the lodge of the ship is not too high.

According to one embodiment, the collecting ends of said two pipes open at the level of two diagonally opposite corner zones of the top wall. Thus, when the ship is immobilized in an inclined position in which it is inclined in terms of listing, at least one of the two sealed pipes opens into a high-up zone of the top wall and is thus able to remove the vapor phase of the cryogenic fluid.

According to one embodiment, the apparatus comprises four sealed pipes each having a collecting end opening to the inside of the tank and each defining a passage for the removal of the vapor phase and the top wall has a rectangular shape, the collecting ends of the four pipes opening at the level of four corner zones of the top wall in such a way that when the ship is immobilized in an inclined position in which it has an inclination in terms of trim and/or of listing, at least one of the four pipes opens at the level of the uppermost point of the top wall and is able to remove the vapor phase of the cryogenic fluid.

Each of the pipes is connected to a vapor collector arranged outside the tank.

Each vapor collector is connected to a vapor injection pipe which passes through the tank and opens below a tank height corresponding to the maximum tank fill level so that said injection pipe is able to reinject the vapor collected into the liquid phase of the cryogenic fluid stored in the tank when the tank is filled with liquefied natural gas to a height corresponding to said maximum fill level. In other words, the injection pipe opens inside the tank at a height such that said injection pipe is able to reinject the collected vapor into the liquid phase of the cryogenic fluid. According to one embodiment, the injection pipe may notably open into the bottom part of the tank, namely below halfway up the tank. Such reinjection of the vapor phase into the liquid phase of the tank makes it possible to limit, or even avoid, the formation of a cloud of potentially flammable vapor in the vicinity of the ship. Advantageously, each collector or each injection pipe is equipped with a pump able to deliver the vapor into the liquid phase of the cryogenic fluid stored in the tank.

The vapor injection pipe comprises an injection lance extending inside the tank and having a plurality of bubbling orifices for reinjecting the vapor phase into the liquid phase of the cryogenic fluid stored in the tank. Such an injection lance makes it possible to encourage exchanges of heat between the reinjected vapor phase and the liquid phase.

The injection lance has the shape of a spiral, something which likewise makes it possible to encourage exchanges of heat.

The apparatus comprises an emergency shaft passing through the top wall of the tank and allowing an emergency pump to be lowered into the tank.

According to one embodiment, the injection lance is mounted removably in said emergency shaft. According to another embodiment, the emergency shaft may itself form a portion of the vapor injection pipe.

According to one embodiment, the apparatus comprises a loading/unloading tower extending over the entire height of the tank, suspended from the top wall of the tank, the loading/unloading tower supporting one or more unloading lines which are each associated with a respective unloading pump supported by the loading/unloading tower, the loading/unloading tower furthermore supporting the emergency shaft.

The or each vapor collector is connected to a flare stack via a safety relief valve.

The safety relief valve may notably be rated at a gauge pressure value of between 200 and 400 millibar, for example of the order of 250 millibar.

The tank is bordered by two transverse cofferdams positioned one on each side of the tank and each delimited by a pair of transverse bulkheads, and each of the pipes passes through one of the transverse bulkheads of the cofferdam adjoining the zone of the top wall at the level of which said pipe opens and is connected to a vapor collector at least partially housed in said cofferdam.

Each collector is connected to the two pipes which open at the level of the corner zones adjoining the cofferdam in which said collector is at least partially housed.

The apparatus comprises a plurality of tanks separated from one another by transverse cofferdams, and each collector housed in a cofferdam separating two tanks is connected to the two pipes of each of the two adjacent tanks which open at the level of the corner zones adjoining the cofferdam in which said collector is housed. Advantageously, in such an apparatus, each of the pipes is equipped with a valve or with a nonreturn check valve so that the gaseous phases are not likely to pass freely from one tank to another.

Each pipe comprises a horizontal portion passing through a transverse bulkhead of a pair of bulkheads defining a cofferdam and a vertical portion connected to said horizontal portion by an elbow portion, said vertical portion passing through an opening formed in the sealing membrane in the top wall which is intended to be in contact with the cryogenic fluid.

Each pipe comprises a portion equipped with a compensator allowing said pipe to be fixed to the transverse bulkhead of the cofferdam through which bulkhead it passes and having corrugations providing the pipe with flexibility to allow it to contract when the tank is cooled.

Each pipe comprises a double-walled tube comprising two concentric walls and an intermediary space between the two concentric walls which is placed under vacuum and/or lined with an insulating material.

The or each tank is arranged in a bearing structure formed by the double hull of a ship and cofferdam transverse bulkheads.

The or each tank comprises, in the thickness direction from the outside toward the inside of the tank, a secondary thermally insulating barrier held against the bearing structure, a secondary sealing membrane borne by the secondary thermally insulating barrier, a primary thermally insulating barrier resting against the secondary sealing membrane and a primary sealing membrane borne by the primary thermally insulating barrier and intended to be in contact with the cryogenic fluid contained in the tank.

The external wall of the double-walled tube is welded in a sealed manner to the primary sealing membrane and the internal wall of the double-walled tube is welded in a sealed manner to the primary sealing membrane, making it possible continuously to ensure that there is a double level of sealing present.

The tank has a polyhedral overall shape defined by a horizontal top wall, a bottom wall, transverse walls and lateral walls, the transverse walls and the lateral walls connecting the bottom wall and the top wall; each wall comprising, in the thickness direction from the outside toward the inside of the tank, at least one thermally insulating barrier and one sealing membrane intended to be in contact with the cryogenic fluid.

The tank has a longitudinal dimension extending in the longitudinal direction of the ship.

According to one embodiment, the longitudinal dimension of the tank extends in the longitudinal direction of the ship. According to another embodiment, the longitudinal dimension of the tank extends in a direction intersecting the longitudinal direction of the ship, for example perpendicularly to the longitudinal direction of the ship.

According to one embodiment, the invention also provides a ship comprising an aforementioned apparatus.

According to one embodiment, the ship is a ship intended for the transport of cryogenic fluid, such as an LNG tanker, for example. According to another embodiment, the ship is a ship propelled by motor means supplied with cryogenic fluid. These embodiments may be combined.

According to one embodiment, the invention also provides a method of loading or unloading such a ship, in which a cryogenic fluid is conveyed through insulated pipelines from or to a floating off-shore or a land-based storage facility to or from a tank of the ship.

According to one embodiment, the invention also provides a transfer system for a cryogenic fluid, the system comprising the aforementioned ship, insulated pipelines arranged in such a way as to connect the tank installed in the double hull of the ship to a floating offshore or to a land-based storage facility and a pump for driving a flow of cryogenic fluid through the insulated pipelines from or to the floating offshore or the land-based storage facility to or from the tank of the ship.

BRIEF DESCRIPTION OF THE DRAWINGS

The invention will be better understood and further objects, details, features and advantages thereof will become more clearly apparent during the course of the following description of a number of particular embodiments of the invention which are given solely by way of nonlimiting illustration with reference to the attached drawings.

DETAILED DESCRIPTION OF EMBODIMENTS

Figure 1:
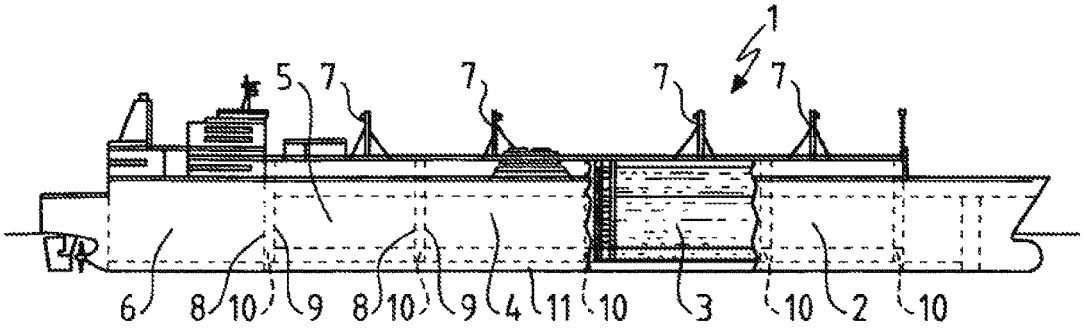
FIG. 1 is a schematic view, in part section, of a ship for transporting liquefied natural gas.
Figure 2:
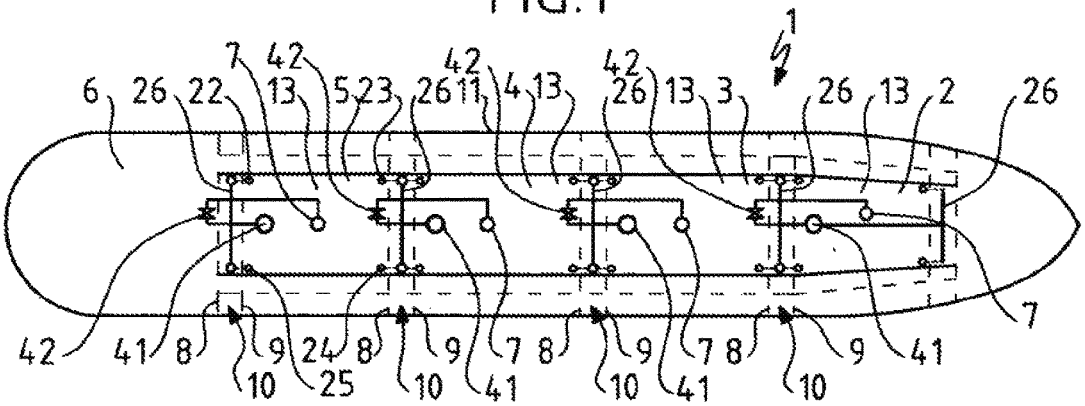
FIG. 2 is a schematic view from above of a ship for transporting liquefied natural gas equipped with vapor removal pipes opening at the level of the four corner zones of the top wall of each tank.

FIGS. 1 and 2 depict a ship 1 equipped with an apparatus for storing and transporting liquefied natural gas, which apparatus comprises four sealed and thermally insulating tanks 2, 3, 4, 5. Each tank 2, 3, 4, 5 is associated with a flare stack 7 which is provided on the deck of the ship 1 and allows gas in the vapor phase to escape in the event of an overpressure inside the associated tank 2, 3, 4, 5.

Near the stern of the ship 1 there is an engine room 6 which conventionally comprises a dual-fuel steam turbine able to operate either by burning diesel oil or by burning evaporation gas coming from the tanks 2, 3, 4, 5.

The tanks 2, 3, 4, 5 have a longitudinal dimension extending in the longitudinal direction of the ship 1. Each tank 2, 3, 4, 5 is bordered at each of its longitudinal ends by a pair of transverse bulkheads 8, 9 delimiting a sealed intermediary space and known by the name of cofferdams 10.

The tanks 2, 3, 4, 5 are thus separated from one another by a transverse cofferdam. It may thus be seen that the tanks 2, 3, 4, 5 are each formed within a bearing structure which is made up, on the one hand, of the double hull of the ship 11 and, on the other hand, by one of the transverse bulkheads 8, 9 of each of the cofferdams 10 bordering the tank 2, 3, 4, 5.

Figure 3:
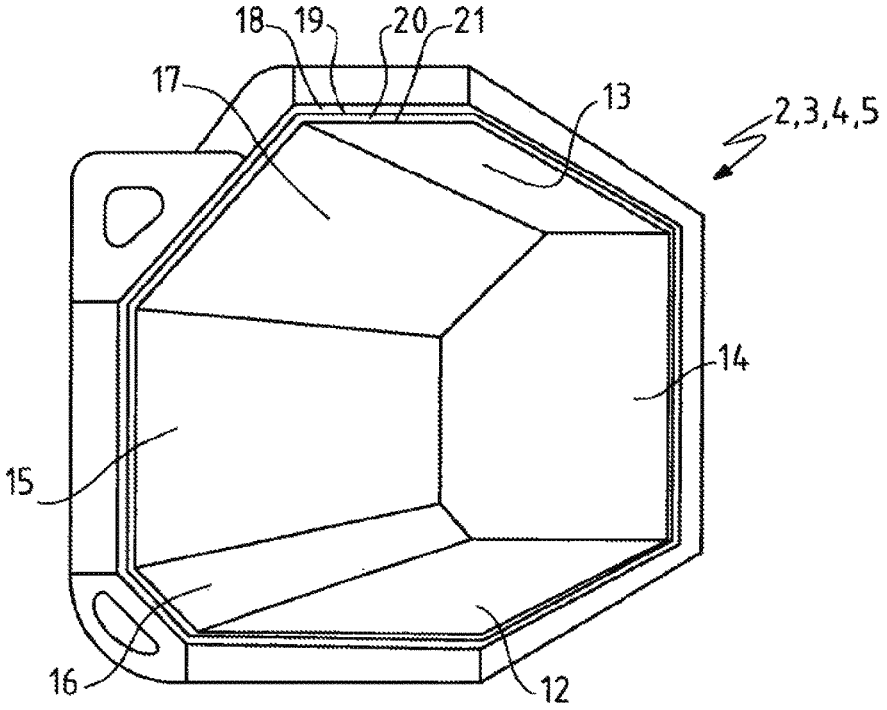
FIG. 3 is a partial view, in perspective and in section, of a tank of a ship for transporting liquefied natural gas.

In FIG. 3 it may be seen that each tank 2, 3, 4, 5 has a polyhedral shape defined by a horizontal bottom wall 12, a horizontal top wall 13 and transverse 14 and lateral 15, 16, 17 walls connecting the bottom wall 12 and the top wall 13. In the embodiment depicted, each tank 2, 3, 4, 5 has a cross section of octagonal shape when viewed in section on a transverse vertical plane. In other words, the tank 2, 3, 4, 5 has vertical lateral walls 15 and inclined lateral walls 16, 17 each connecting one of the vertical lateral walls 15 to the top wall 13 or to the bottom wall 12. The transverse walls 14 are vertical. The bottom wall 12, top wall 13 and lateral walls are rectangular in shape. The transverse walls 14 though have an octagonal shape. In another embodiment which has not been depicted, the tanks have a hexagonal cross section. In that case, the vertical lateral walls 15 extend downward as far as the bottom wall 12 and the transverse walls 14 therefore have a hexagonal shape. It will, however, be observed that the shape of a tank 2, 3, 4, 5 is described above by way of example and that numerous changes can be made to it. In particular, with the exception of the top wall 13, the other walls of the tank may be partially or integrally curved.

The tanks 2, 3, 4, 5 are membrane-type tanks. Each tank wall comprises, from the outside toward the inside of the tank, a secondary thermally insulating barrier 18 comprising lagging elements juxtaposed on the bearing structure and anchored thereto by secondary retaining members, a secondary sealing membrane 19 borne by the secondary thermally insulating barrier 18, a primary thermally insulating barrier 20 comprising juxtaposed lagging elements anchored to the secondary sealing membrane 19 by primary retaining members and a primary sealing membrane 21 borne by the primary thermally insulating barrier 20 and intended to be in contact with the liquefied natural gas contained in the tank. In such membrane-type tanks the liquefied natural gas is stored at pressures close to atmospheric pressure.

According to one embodiment, the membrane-type tanks are made using the NO96 technology notably described in document FR2968284 A1. Thus, the lagging elements are, for example, formed by insulating boxes comprising a bottom panel and a top panel which are parallel, spaced apart in the thickness direction of the insulating box, bearing elements extending in the thickness direction, optionally peripheral partitions, and an insulating filling housed inside in the insulating boxes. The top and bottom panels, the peripheral partitions and the bearing elements are made for example of wood or thermoplastic composite material. The insulating filling may be made of glass wool, cellulose wadding or a polymer foam, such as polyurethane foam, polyethylene foam, or polyvinyl chloride foam or of a granular or pulverulent material—such as perlite, vermiculite or glass wool—or a nanoporous material of the aerogel type. Furthermore, the primary sealing membranes 21 and secondary sealing membranes 19 comprise a continuous layer of metal strakes with turned-up edges, said strakes being welded by their turned-up edges to parallel weld supports held on the insulating boxes. The metal strakes are, for example, made of Invar®: which means to say an alloy of iron and of nickel the thermal expansion coefficient of which is typically comprised between $1.2\times10^{-6}$ and $2\times10^{-6}$ $K^{-1}$ or from an iron alloy with a high manganese content the expansion coefficient of which is typically of the order of $7\times10^{-6}$ $K^{-1}$.

According to another embodiment, the membrane-type tanks are made using the Mark III technology notably described in document FR2691520 A1. In such a tank, the insulating elements are, for example, made up of a layer of insulating polymer foam sandwiched between two sheets of plywood bonded to said layer of foam. The insulating polymer foam may notably be a polyurethane-based foam. The insulating elements of the secondary thermally insulating barrier are covered with a secondary sealing membrane 19 formed of a composite material comprising a sheet of aluminum sandwiched between two sheets of fiberglass fabric. The primary sealing membrane 21 itself is obtained by assembling a plurality of metal sheets, welded together along their edges, and having corrugations extending in two perpendicular directions. The metal plates are, for example, made of stainless steel or aluminum sheet, shaped by bending or by pressing.

The structure of a membrane-type tank is described above by way of example and numerous changes can be made therein. In particular, the sealing membrane may be made with metal plates whose thickness is greater or lesser, the thickness of the sealing membrane being capable of varying between a few tenths of a millimeter and several centimeters.

Returning to FIG. 2, it may be seen that the apparatus comprises, for each tank 2, 3, 4, 5, four vapor removal pipes 22, 23, 24, 25 passing through the tank in such a way as to define a passage for the removal of the vapor produced by the evaporation of the liquefied natural gas in the tank. The vapor removal pipes 22, 23, 24, 25 open at the level of the four corner zones of the top wall 13. Thus, if a ship equipped with such an apparatus were to find itself immobilized in an inclined position, at least one of the four vapor removal pipes 22, 23, 24, 25 of each tank would be in communication with the vapor phase and would thus be able to remove it from the tank in order to avoid overpressures and to do so whatever the inclination in terms of trim, namely whatever the inclination of the longitudinal axis of the ship with respect to the horizontal and whatever the inclination in terms of listing, namely whatever the inclination of a transverse axis of the ship with respect to the horizontal.

Moreover, each vapor removal pipe 22, 23, 24, 25 is connected to a collector 26 arranged at the level of the cofferdam 10 adjacent to the corner zone into which said pipe opens. Advantageously, for each tank, the two pipes 22 and 25 on the one hand, and 23 and 24 on the other, which open at the level of the same longitudinal end of the top wall 13 are connected to the one same collector 26.

Furthermore, in the embodiment depicted, the collectors 26 which are arranged at the level of the cofferdams 10 separating two adjacent tanks 2, 3, 4, 5 are connected to the two pipes 22, 25 or 23, 24 of each of the two adjacent tanks. Such an arrangement makes it possible then to optimize the number of collectors 26 needed. However, in that case, it is advantageous to equip each of the pipes with a nonreturn check valve or with a valve so as to avoid communication of gas between the tanks. The valves, for example electrically operated valves, are able to be controlled remotely, for example from the deck of the ship. Thus, each of the valves can be opened or closed according to the inclination in terms of trim and according to the inclination in terms of listing.

In another embodiment which has not been depicted, each collector 26 is connected to just two vapor removal pipes 22, 25 or 23, 24 of one same tank. As a result, for each cofferdam zone 10 separating two adjacent tanks two collectors 26 respectively handle the collection of vapor coming from each of the two adjacent tanks. Such an arrangement makes it possible to avoid liquefied natural gas passing from one tank to the other when the vapor collected is intended to be reinjected into the tanks.

Each collector 26 is connected both to a vapor injection pipe 41 able to allow the collected vapor to be reinjected into the liquid phase of the liquefied natural gas stored in the tank and to a flare stack 7 via a safety relief valve 42.

Figure 4:
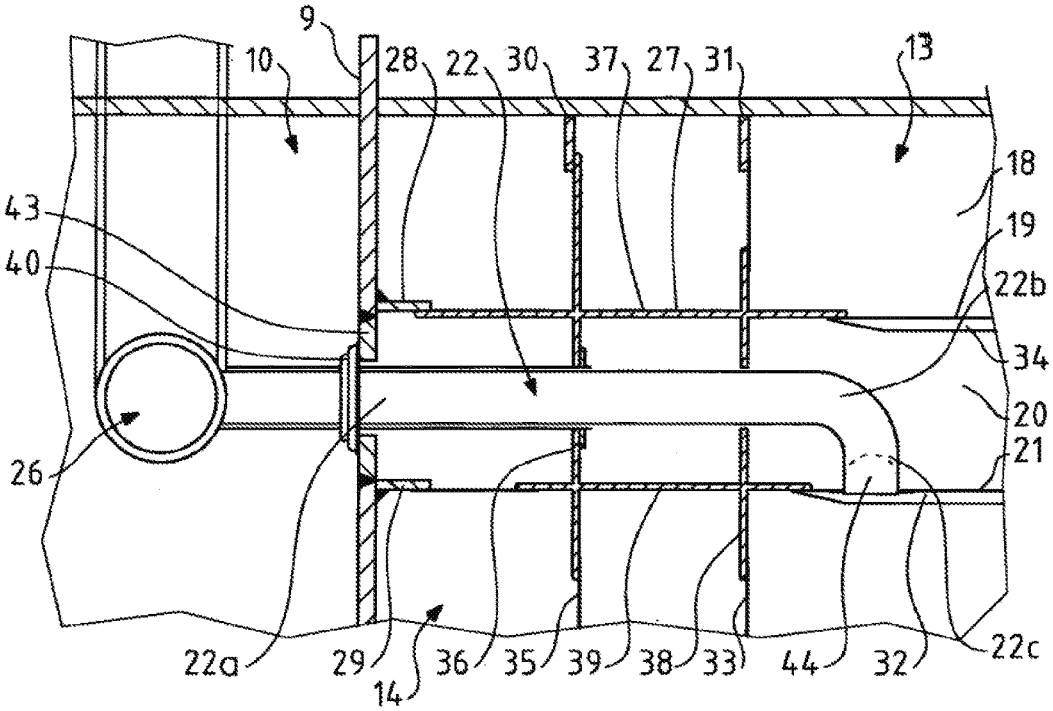
FIG. 4 is a view in longitudinal section of a tank illustrating in detail how a vapor removal pipe passes through walls of the tank and is connected to a collector arranged in a cofferdam.

A study of FIG. 4 reveals a tank corner at the level of an intersection between a transverse wall 14 and the top wall 13. The tank depicted being one using NO96 technology, it is equipped in this zone with a connecting ring 27 formed of an assembly of several welded sheets made for example of Invar®. The connecting ring 27 is fixed, with two flanges 28, 29 perpendicular to the transverse wall 14 and welded to the cofferdam transverse bulkhead 9 and with two flanges 30, 31 perpendicular to the top wall 13 and welded to the internal bulkhead of the double hull of the ship. The connecting ring 27 comprises a set of primary plates 38, 39 bearing primary anchorage surfaces to which metal strakes 32, 33 of the primary sealing membrane 21 are welded and which ensure the continuity of the primary sealing membrane 21. Likewise, the connecting ring 27 comprises a set of secondary plates 36, 37 bearing secondary anchoring surfaces to which metal strakes 34, 35 of the secondary sealing membrane 19 are welded ensuring the continuity of the secondary sealing membranes 19.

The vapor removal pipe 22 has an elbow and comprises a horizontal portion 22*a* connected by an elbow portion 22*b* to a vertical portion 22*c* the end of which opens into the internal space of the tank. The horizontal portion 22*a* passes through an opening formed in the cofferdam transverse bulkhead 9 and extends as far as the primary thermally insulating barrier 20 of the top wall 13, passing through the secondary thermally insulating barrier 18 of the transverse wall 14 and the sets of secondary 36, 37 and primary 38, 39 plates of the connecting ring 27. The vertical portion 22*c* passes through an opening formed in the primary sealing membrane 21 of the top wall 13 such that the collecting end of the pipe 22 opens inside the tank. The collecting end of the pipe 22 may be equipped with a filter 44.

In the embodiment depicted, the removal pipe 22 is advantageously formed by a double-walled tube the two concentric walls of which are made of stainless steel and the intermediary space between which is evacuated and/or lined with an insulating material. The external wall of the double-walled tube stops at the level of the set of secondary plates 36, 37 of the connecting ring 27 and is welded thereto whereas the end of the internal wall of the double-walled tube passes through the primary thermally insulating barrier 20 then the primary sealing membrane 20 and is welded to this in such a way as to ensure the sealing of the primary sealing membrane 21.

The double-walled tube comprises, at the level where it passes through the transverse bulkhead 9 of the cofferdam, a double compensator 40 affording the pipe 22 the flexibility that allows it to contract when the tank is cooled. To do that, the double compensator 40 comprises, at the level of the external wall, an external portion exhibiting a series of corrugations and, at the level of the internal wall, an internal portion exhibiting a series of corrugations. The double compensator 40 also makes it possible to fix the vapor removal pipe 22 to the cofferdam transverse wall 9. To do that, in the embodiment depicted, the corrugated external portion of the double compensator 40 is welded to a stainless steel insert 43 which is mounted inside an opening formed in the transverse wall 9 of the cofferdam and which is welded thereto.

The pipe 22 in this instance is connected to a collector 26 which comprises a tube extending inside the cofferdam 10 in a transverse direction and which thus allows vapor from two pipes 22, 25 opening into two corner zones of the top wall which are arranged at the level of the same longitudinal end of the tank to be collected.

Figure 5:
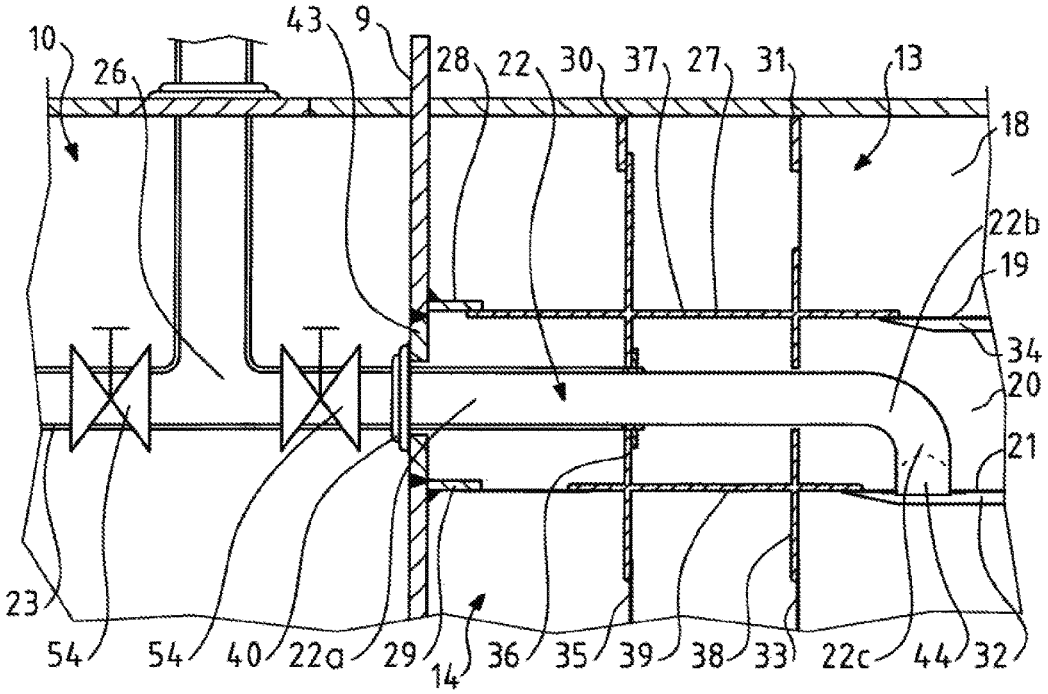
FIG. 5 is a view in longitudinal section of a tank illustrating in detail how a vapor removal pipe passes through the walls of the tank and is connected to a collector arranged in a cofferdam separating two tanks.
Figure 6:
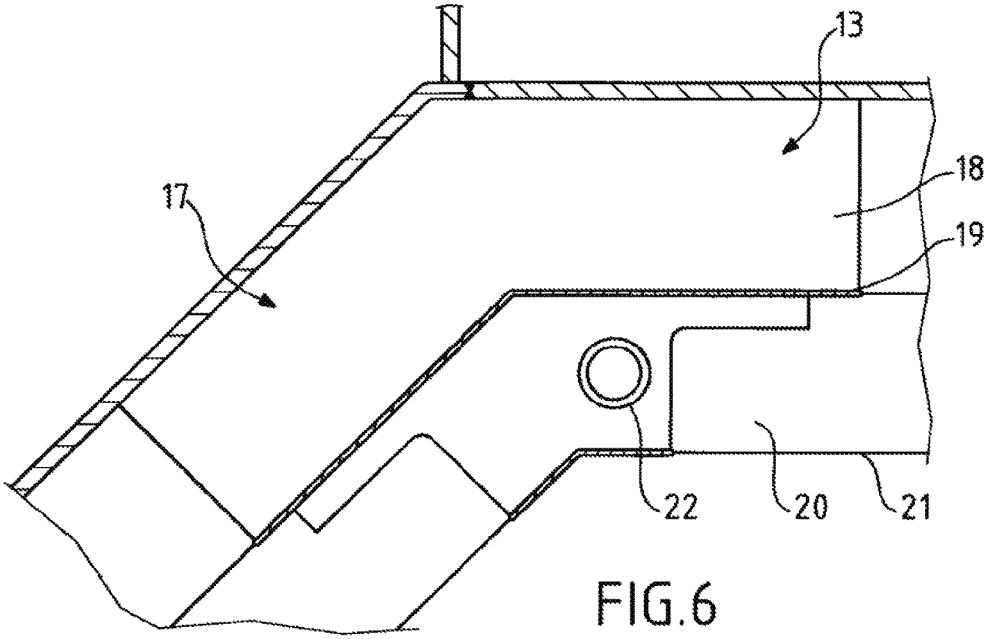
FIG. 6 is a view in cross section of a tank illustrating the passage of a vapor removal pipe through the walls of the tank.

The embodiment in FIG. 5 differs from that of FIG. 4 in that the collector 26 here is connected to the two vapor removal pipes 22, 23 opening in the two facing corner zones of two adjacent tanks separated by the cofferdam 10. The collector 26 also comprises a tube, not depicted in FIG. 5, which extends along the deck, in the transverse direction of the ship, and thus allows vapor from two other pipes 24, 25 which open at the level of the other two corner zones adjacent to said cofferdam 10 to be collected. Moreover, each removal pipe 22, 23 is equipped with a valve 54 able to allow or prevent the passage of the gaseous phase from the removal pipe toward the collector 26 so as to allow the tanks to be isolated from one another.

Figure 7:
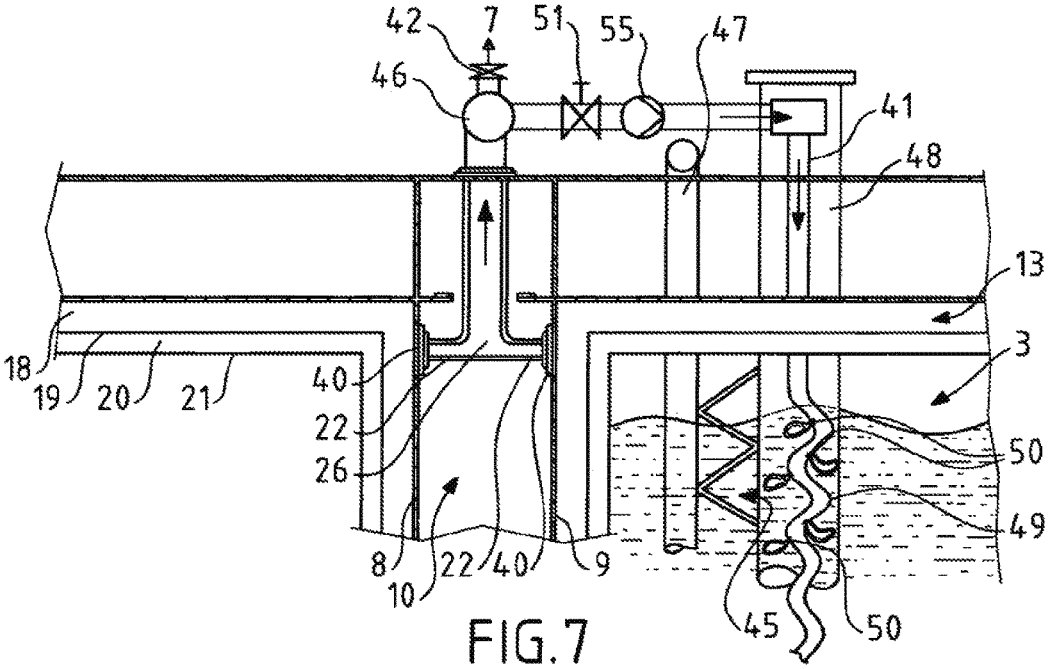
FIG. 7 is a view in longitudinal section of a tank illustrating in detail a vapor collector arranged in a transverse cofferdam separating two adjacent tanks and how it is connected, on the one hand, to a flare stack and, on the other hand, to an injection lance for injecting vapor into the liquid phase of the liquefied natural gas stored in the tank.

In conjunction with FIG. 7 it may be seen that the collector 26 is connected via a three-way coupling 46 on the one hand, to a vapor injection pipe 41 able to allow the collected vapor phase to be reinjected into the liquid phase of the liquefied natural gas stored in a tank and, on the other hand, to a flare stack 7 via a safety relief valve 42. Each collector 26 or vapor injection pipe 41 is equipped with a pump 55 allowing the collected gaseous phase to be delivered into the liquid phase.

The apparatus further comprises a loading/unloading tower 45, depicted schematically in FIG. 7, for loading the cargo into the tank, before it is transported, and for unloading the cargo after it has been transported. The loading/unloading tower 45 extends over substantially the entire height of the tank, near a transverse bulkhead 9 of the cofferdam. The loading/unloading tower 45 is suspended from the top wall 13 and may notably be made up of a structure of the tripod type, namely having three vertical masts. The loading/unloading tower 45 supports one or more unloading lines 47 and one or more loading lines, none of which are depicted. Each of the unloading lines 47 is associated with a respective unloading pump, not depicted, which is itself supported by the loading/unloading tower 45. Moreover, the apparatus comprises an emergency shaft 48 passing through the top wall 13 of the tank and extending over substantially the entire height of the tank and allowing an emergency pump and an unloading line to be lowered in the event of the failure of the other unloading pumps.

In the embodiment depicted, the emergency shaft 48 is put to beneficial use to allow the collected vapor to be reinjected into the liquid phase of the liquefied natural gas stored in the tank without the need to create an additional passage through the walls of the tank.

In order to do this, in the embodiment depicted, the vapor injection pipe 41 comprises an injection lance 49 arranged inside the emergency shaft. The injection lance 49 extends over a substantial portion of the height of the tank so as to dip down inside the liquid phase of the liquefied natural gas. In the depicted embodiment, the injection lance 49 comprises a spiral shape and a plurality of bubbling orifices 50 distributed along the injection lance. Such a structure of the injection lance 49 makes it possible to encourage exchange of heat between the reinjected vapor and the liquid phase of the liquefied natural gas.

The injection lance 49 is mounted removably inside the emergency shaft 48 so that it can be withdrawn from the emergency shaft when the emergency pump needs to be lowered down into the emergency shaft 48. Moreover, the injection lance is connected to the three-way coupling 46 by means of an isolation valve 51 so as to allow the reinjection of vapor into the tank to be interrupted particularly when the injection lance 49 needs to be removed and the emergency pump lowered in the emergency shaft 48.

Moreover, it will be noted that the safety valve makes it possible to direct vapor to the flare stack so that the vapor can be discharged into the atmosphere thereby limiting overpressures inside the tank when the pressure of the vapor is above a threshold. The safety relief valve may notably be rated at a gauge pressure value of between 200 and 400 millibar, for example of the order of 250 millibar.

Figure 8:
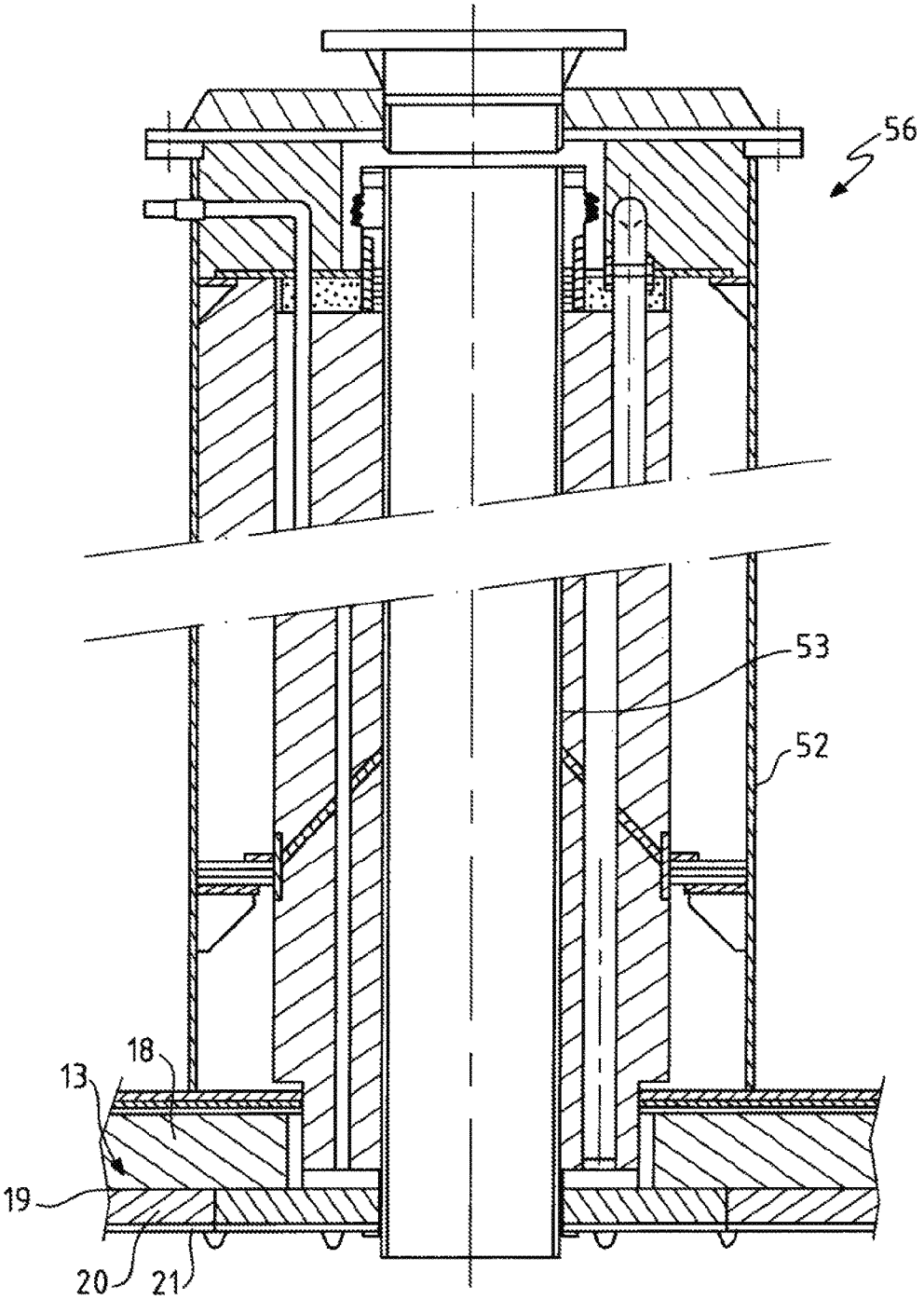
FIG. 8 is a view in section of a top wall of a tank illustrating in detail a vapor collecting device passing through said top wall.

Each tank 2, 3, 4, 5 may also be equipped with a vapor collecting device 56 as illustrated in FIG. 8 passing through the top wall 14 of the tank, here in a central zone. The bearing structure comprises a circular opening around which is welded a shaft 52 which extends to the outside of the bearing structure. A metal collecting pipe 53 is anchored inside the shaft 52 and intended to extract the vapors produced by evaporation of the liquefied natural gas in the tank. The collecting pipe 53 passes through the top wall 13 at the center of the circular opening and the thermally insulating barriers 18, 20 and the sealing membranes 19, 21. This collecting pipe 53 is notably connected to a collector of vapor outside the tank which extracts this vapor and is able to transmit the vapor selectively to a flare stack 7, to the steam turbine for propelling the ship or to a liquefaction device so that the fluid can then be reintroduced into the tank.

The diameter and the height of the collecting pipe 53 are liable to vary according to the dimensions of the tank and those of the ship; the diameter and the height of the collecting pipe being important when the ship is an LNG tanker and more modest when the tank is intended to store liquefied natural gas used for supplying the propulsion means of the ship.

Figure 10:
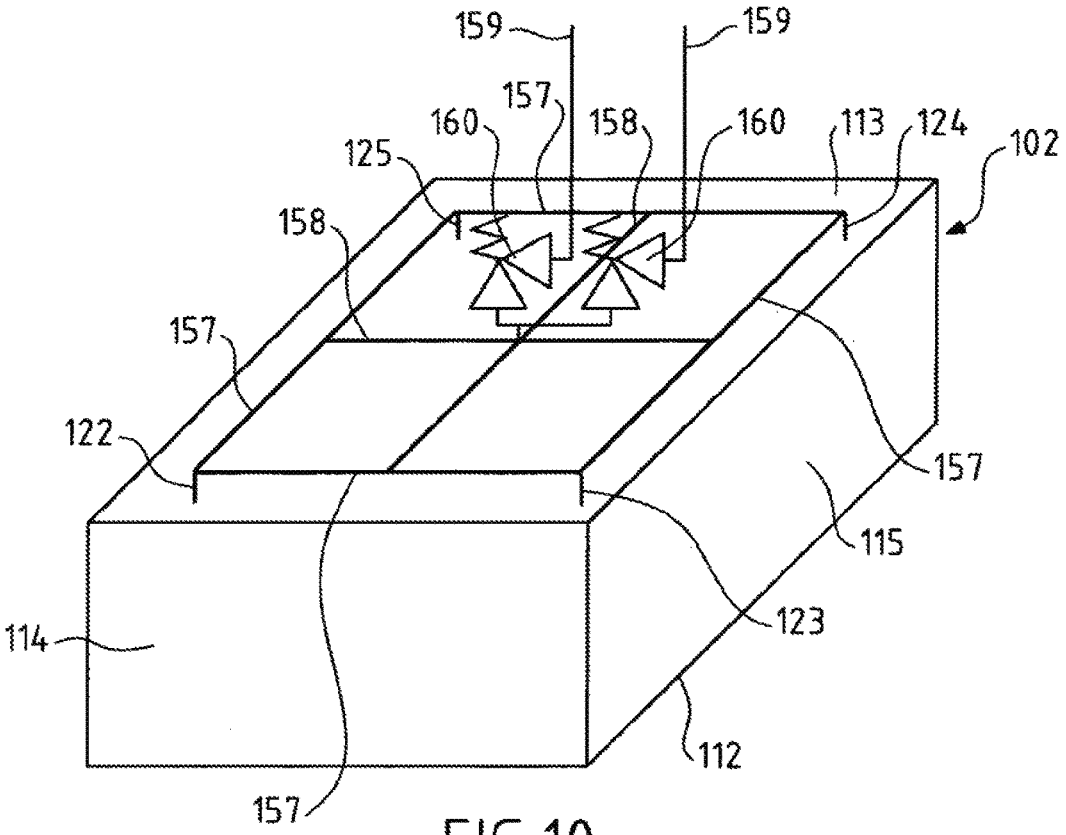
FIG. 10 is a schematic perspective view of an apparatus for storing a cryogenic fluid according to another embodiment.
Figure 11:
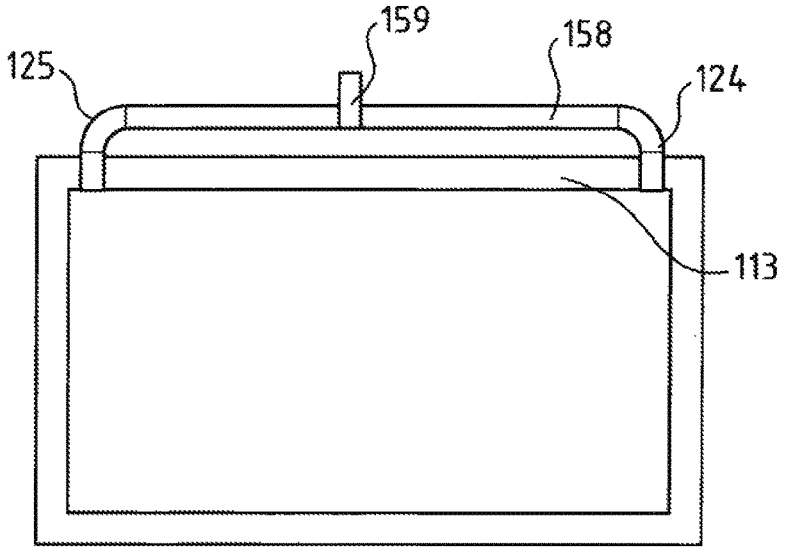
FIG. 11 is a cross-sectional view of the apparatus for storing a cryogenic fluid of FIG. 10.
Figure 12:
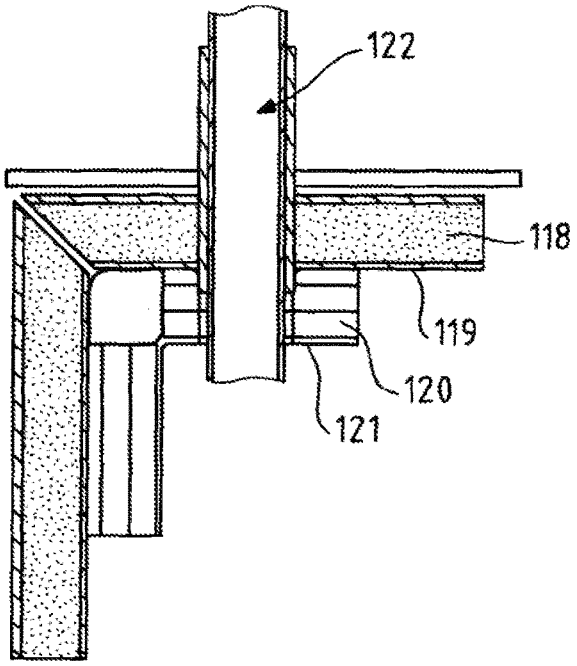
FIG. 12 is a partial sectional view illustrating in detail the passage of a pipe for evacuating the steam through a top wall of the tank.

Referring to FIGS. 10, 11 and 12, a liquefied natural gas storage apparatus is observed. The elements identical or similar to the elements of FIGS. 1 to 8, that is to say fulfilling the same function, bear the same reference numeral increased by 100.

The apparatus comprises a tank 102, which can in particular be used to store liquefied natural gas intended to serve as fuel for the propulsion of a ship. In this example, the tank 102 has a rectangular parallelepiped shape defined by a bottom wall 112, a top wall 113, two vertical side walls 115 and two vertical transverse walls 114. The longitudinal dimension of the tank 102 may, for example, be oriented in the longitudinal direction of the ship or perpendicularly thereto.

The apparatus comprises four vapor removal pipes 122, 123, 124, 125 which each open at one of the four corner areas of the top wall 113. As shown in FIGS. 11 and 12, the four vapor removal pipes 122, 123, 124, 125 pass through the top wall 113 so as to open into the internal space of the tank 102 at the level of the primary sealing membrane 121 of the top wall 113. As shown in FIG. 12, the vapor removal pipe 122 is formed by a double-walled tube whose outer wall is sealingly connected to the secondary sealing membrane 119 while the outer wall is sealingly connected, for example by welding, to the primary sealing membrane 121.

In FIG. 10, it is observed that the vapor removal pipes 122, 123, 124, 125 are connected to one another by a collector network. The collector network comprises four pipes 157 defining a rectangle and each connecting one of the vapor removal pipes 122, 123, 124, 125 with another vapor removal pipe disposed at a corner area adjacent to the top wall 113. The collector network also comprises two other pipes 158 which each connect two parallel pipes 157 close to their center. The two ducts 158 are connected to one another. The intersection between the two ducts 158 is connected to the flare stack and/or to a circuit for using natural gas in the vapor phase by one or two ducts 159, each of which is equipped with a relief valve 160. Such an arrangement thus makes it possible to pool the safety valves 160 for all of the vapor removal pipes 122, 123, 124, 125 of the same tank and this without risk of causing a liquid phase to be expelled towards the flare stack and/or the vapor-phase gas utilization circuit when the tank is inclined.

Figure 13:
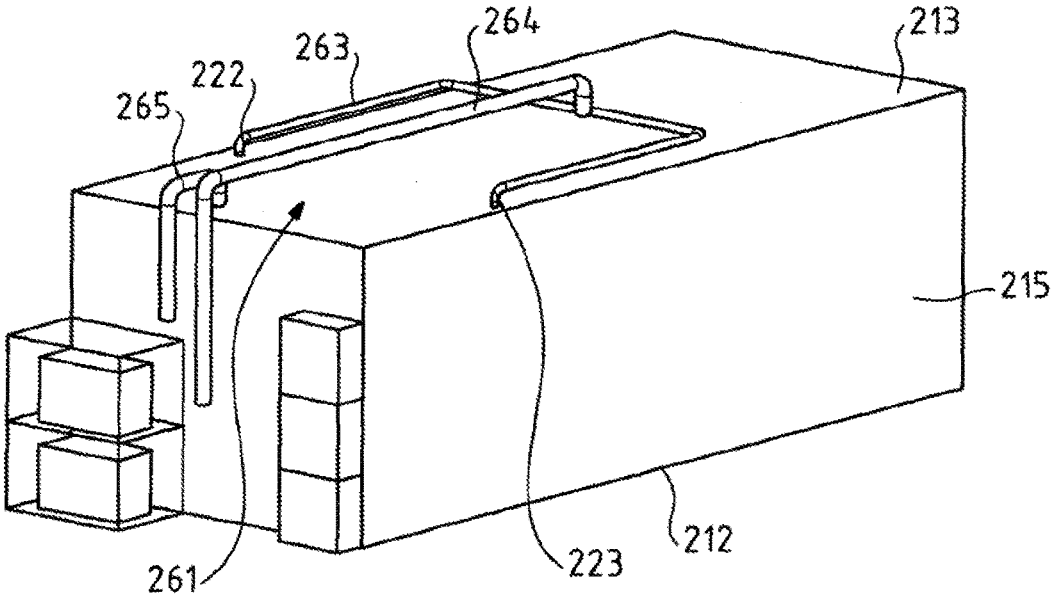
FIG. 13 is a schematic perspective view of an apparatus for storing a cryogenic fluid according to another embodiment.

In FIG. 13, elements identical or similar to the elements of FIGS. 1 to 8, that is to say fulfilling the same function, bear the same reference numeral increased by 200. The apparatus here comprises only two vapor removal pipes 222, 223. The two pipes 222, 223 open out, inside the tank 202, at two opposite ends in the transverse direction of the ship. Such an arrangement makes it possible to limit the number of vapor removal pipes 222 223 so as to limit the bulk and the cost of the apparatus while ensuring an effective evacuation of the vapor phase of liquefied natural gas when the ship is Immobilized in an inclined position in which it has an lodging inclination. The lodging inclination of the ship is the inclination likely to be the most important.

Besides, the installation comprises a collector network comprising two ducts 263 which each make it possible to connect one of the two removal vapor pipes 222, 223 to a collecting duct 264. The pipe 264 is equipped with a safety valve, not shown, and conducts the gas in the vapor phase to a flare stack and/or to a plant for using natural gas in the vapor phase.

It is also observed that the installation also comprises a pipe 265 passing through the ceiling wall 213 of the tank and through which pass one or more loading and/or unloading lines, not shown, making it possible to load and/or to unload the cargo.

Figure 9:
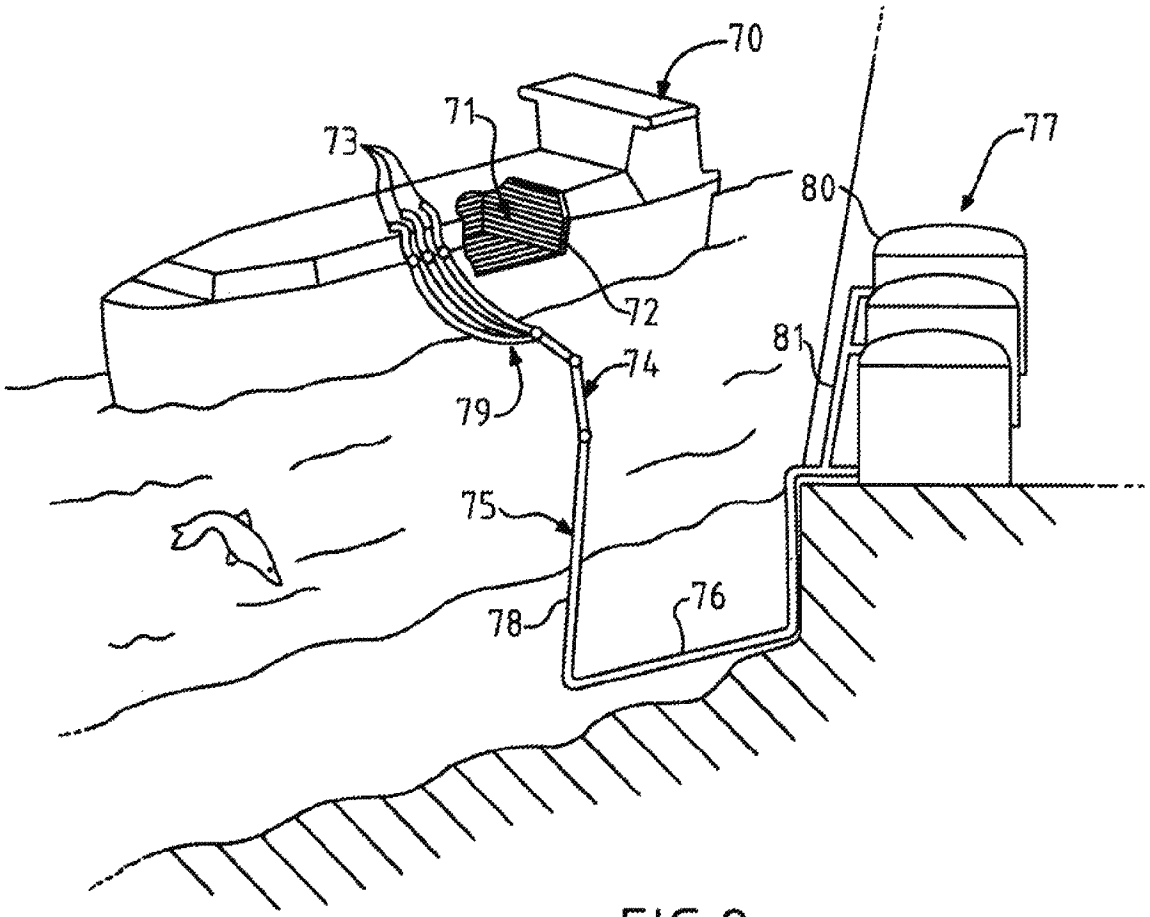
FIG. 9 is a schematic view with cutaway of a ship comprising a liquefied natural gas storage tank and of a terminal for loading/unloading this tank

Reference is made to FIG. 9 which shows a cutaway view of a methane ship 70 equipped with such an apparatus for storing and transporting liquefied natural gas. FIG. 9 shows a sealed and insulated tank 71 of prismatic overall shape mounted in the double hull 72 of the ship.

In a way known per se, loading/unloading pipe lines 73, arranged on the upper deck of the ship, may be coupled, by means of suitable connectors, to a maritime or harbor terminal to transfer a cargo of liquefied natural gas from or to the tank 71.

FIG. 9 also depicts an example of a maritime terminal comprising a loading and unloading station 75, an underwater pipe 76 and an on-shore facility 77. The loading and unloading station 75 is a fixed off-shore facility comprising a mobile arm 74 and a tower 78 supporting the mobile arm 74. The mobile arm 74 bears a cluster of insulated flexible hoses 79 which can be connected to the loading/unloading pipelines 73. The orientable mobile arm 74 adapts to suit all sizes of methane ship. A connecting pipe, not depicted, extends inside the tower 78. The loading and unloading station 75 allows the methane ship 70 to be loaded and unloaded from or to the on-shore facility 77. The latter comprises liquefied gas storage tanks 80 and connecting pipes 81 connected by the underwater pipe 76 to the loading or unloading station 75. The underwater pipe 76 allows liquefied gas to be transferred between the loading or unloading station 75 and the on-shore facility 77 over a long distance, for example 5 km, making it possible to keep the methane ship 70 standing offshore by a large distance during the loading and unloading operations.

In order to generate the pressure needed for the transfer of the liquefied gas, use is made of pumps carried onboard in the ship 70 and/or of pumps with which the land-based facility 77 is equipped and/or of pumps with which the loading and unloading station 75 is equipped.

Although the invention has been described in conjunction with a number of specific embodiments, it is quite obvious that it is not in any way restricted thereto and that it comprises all technical equivalents of the means described and combinations thereof where these fall within the scope of the invention.

The use of the verb "comprise", "have" or "include" and of the conjugated forms thereof does not exclude there being elements or steps other than those listed in a claim. The use of the indefinite article "a" or "an" for an element or a step does not, unless mentioned otherwise, exclude there being a plurality of such elements or steps present.

In the claims, any reference sign between parentheses must not be interpreted as a limitation on the claim.

The invention claimed is:

1. An apparatus for storing and transporting a cryogenic fluid, which apparatus is carried onboard a ship (1), the apparatus comprising a sealed and thermally insulating tank (2, 3, 4, 5, 102, 202) intended for the storage of the cryogenic fluid in a state of liquid-vapor diphasic equilibrium, said tank (2, 3, 4, 5, 102, 202) having a horizontal top wall (13, 113, 213), comprising, in the thickness direction from the outside toward the inside of the tank, at least one thermally insulating barrier (18, 20, 118, 120) and one sealing membrane (21, 121) intended to be in contact with the cryogenic fluid;

the apparatus comprising at least two sealed pipes (22, 23, 24, 25) passing through the tank in such a way as to define a passage for the removal of the vapor phase of the cryogenic fluid from inside to outside the tank, the two pipes (22, 23, 24, 25, 122, 123, 124, 125, 222, 223) each comprising a collection end opening inside the tank at the level of the sealing membrane (21, 121) of the top wall (13, 113, 213);

the collecting ends of said two pipes opening to the inside of the tank at the level of two zones of the top wall (13, 113, 213) which are situated at two opposite ends of said top wall (13, 113, 213), each of the pipes (22, 23, 24, 25, 122, 123, 124, 125, 222, 223) being connected to a vapor collector (26, 159, 264) arranged outside the tank (2, 3, 4, 5, 102, 202), the or each vapor collector (26, 159, 264) being connected to a flare stack (7)

and/or to a vapor-phase gas utilization circuit via a safety relief valve (42, 160).

2. The apparatus as claimed in claim 1, in which said two ends of the top wall (13, 113, 213) are opposite in a transverse direction perpendicular to the longitudinal direction of the ship (1).

3. The apparatus as claimed in claim 1, in which said two ends of the top wall (13, 113, 213) are opposite in the longitudinal direction of the ship.

4. The apparatus as claimed in claim 1, in which the collecting ends of said two pipes (22, 23, 24, 25, 122, 123, 124, 125) open at the level of two diagonally opposite corner zones of the top wall (13).

5. The apparatus as claimed in claim 4, comprising four sealed pipes (22, 23, 24, 25, 122, 123, 124, 125) each having a collecting end opening to the inside of the tank at the level of the sealing membrane (21, 121) of the top wall (13, 113) and each defining a passage for the removal of the vapor phase and in which apparatus the top wall (13, 113) has a rectangular shape, the collecting ends of the four pipes (22, 23, 24, 25) opening at the level of four corner zones of the top wall (13, 113) in such a way that when the ship is immobilized in an inclined position in which it has an inclination in terms of trim and/or of listing, at least one of the four pipes opens at the level of the uppermost point of the top wall and is able to remove the vapor phase of the cryogenic fluid.

6. The installation as claimed in claim 1, in which each vapor collector (26) is connected to a vapor injection pipe (41) which passes through the tank (2, 3, 4, 5) and opens inside the tank below a tank height corresponding to a maximum tank fill level so that said injection pipe is able to reinject the vapor collected via the vapor collector (26) into the liquid phase of the cryogenic fluid stored in the tank when the tank is filled with liquefied natural gas to a height corresponding to said maximum fill level, each vapor collector (26) or each vapor injection pipe (41) being equipped with a pump able to deliver the collected vapor into the liquid phase of the cryogenic fluid.

7. The apparatus as claimed in claim 6, in which the vapor injection pipe (41) comprises an injection lance (49) extending inside the tank (2, 3, 4, 5) and having a plurality of bubbling orifices (50) for reinjecting the vapor phase into the liquid phase of the cryogenic fluid stored in the tank.

8. The apparatus as claimed in claim 7, comprising an emergency shaft (48) passing through the top wall (13) of the tank and allowing an emergency pump to be lowered into the tank, and in which the injection lance (49) is mounted removably in said emergency shaft (48).

9. The apparatus as claimed in claim 8, comprising a loading/unloading tower (45) extending over the entire height of the tank (2, 3, 4, 5), suspended from the top wall (13) of the tank, the loading/unloading tower (45) supporting one or more unloading lines (47) which are each associated with a respective unloading pump supported by the loading/unloading tower, said loading/unloading tower furthermore supporting said emergency shaft (48).

10. The apparatus as claimed in claim 1, in which the tank is bordered by two transverse cofferdams (10) positioned one on each side of the tank (2, 3, 4, 5) and each delimited by a pair of transverse bulkheads (8, 9), and in which each of the pipes (22, 23, 24, 25) passes through one of the transverse bulkheads (8, 9) of the cofferdam (10) adjoining the zone of the top wall (13) at the level of which said pipe (22, 23, 24, 25) opens and is connected to a vapor collector (26) at least partially housed in said cofferdam (10).

11. The apparatus as claimed in claim 10, in which each collector (26) is connected to the two pipes (22, 25 or 23, 24) which open at the level of the corner zones adjoining the cofferdam (10) in which said collector (26) is at least partially housed.

12. The apparatus as claimed in claim 11, comprising a plurality of tanks (2, 3, 4, 5) separated from one another by transverse cofferdams (10), and in which apparatus each collector (26) housed in a cofferdam separating two tanks (2, 3, 4, 5) is connected to the two pipes (22, 25 and 23, 24) of each of the two adjacent tanks which open at the level of the corner zones adjoining the cofferdam (10) in which said collector (26) is housed.

13. The apparatus as claimed in claim 1, in which each pipe (22, 23, 24, 25, 122, 123, 124, 125, 222, 223) comprises a portion equipped with a compensator (40) allowing said pipe (22, 23, 24, 25) to be fixed to the transverse bulkhead (9) of the cofferdam through which bulkhead it passes and having corrugations providing the pipe (22, 23, 24, 25) with flexibility to allow it to contract when the tank is cooled.

14. The apparatus as claimed in claim 1, in which each pipe (22, 23, 24, 25) comprises a double-walled tube comprising two concentric walls and an intermediary space between the two concentric walls which is under vacuum and/or lined with an insulating material.

15. The apparatus as claimed in claim 1, in which the tank (2, 3, 4, 5, 102, 202) has a longitudinal dimension extending in the longitudinal direction of the ship (1) and has a polyhedral overall shape defined by a horizontal top wall (13, 113, 213), a bottom wall (12, 112, 212), transverse walls and lateral walls, the transverse walls and the lateral walls connecting the bottom wall (12, 112, 212) and the top wall (13, 113, 213; each wall (12, 13, 14, 15, 16, 17) comprising, in the thickness direction from the outside toward the inside of the tank, at least one thermally insulating barrier (18, 20, 118, 120) and one sealing membrane (21, 121) intended to be in contact with the cryogenic fluid.

16. A ship (70) comprising an apparatus (1) as claimed in claim 1.

17. A method of loading or unloading a ship (70) as claimed in claim 16, in which a cryogenic fluid is conveyed through insulated pipelines (73, 79, 76, 81) from or to a floating off-shore or a land-based storage facility (77) to or from a tank of the ship (71).

18. A transfer system for a cryogenic fluid, the system comprising a ship (70) as claimed in claim 16, insulated pipelines (73, 79, 76, 81) arranged in such a way as to connect the tank (71) installed in the double hull of the ship to a floating offshore or to a land-based storage facility (77) and a pump for driving a flow of cryogenic fluid through the insulated pipelines from or to the floating offshore or the land-based storage facility to or from the tank of the ship.

* * * * *